US005178531A

United States Patent [19]

Naito et al.

[11] Patent Number: 5,178,531

[45] Date of Patent: Jan. 12, 1993

[54] FLUIDIZED BED COMBUSTION FURNACE

[75] Inventors: Takeyuki Naito; Keiichi Sato; Hiroshi Yoshida, all of Yokohama, Japan

[73] Assignee: Ebara Corporation, Tokyo, Japan

[21] Appl. No.: 741,514

[22] PCT Filed: Feb. 16, 1990

[86] PCT No.: PCT/JP90/00187

§ 371 Date: Aug. 8, 1991

§ 102(e) Date: Aug. 8, 1991

[87] PCT Pub. No.: WO90/09549

PCT Pub. Date: Aug. 23, 1990

[30] Foreign Application Priority Data

Feb. 17, 1989 [JP] Japan ..... 1-37870

[51] Int. Cl.[5] ..... F23C 11/02

[52] U.S. Cl. ..... 431/170; 431/7; 110/245

[58] Field of Search ..... 431/7, 170; 110/243, 110/245, 263, 347, 244; 122/4 D

[56] References Cited

U.S. PATENT DOCUMENTS

| | | | |
|---|---|---|---|
| 4,075,953 | 2/1978 | Sowards | 110/8 F |
| 4,377,119 | 3/1983 | Noack | 122/4 D X |
| 4,597,362 | 7/1986 | Daudet et al. | 122/4 D |
| 4,940,006 | 7/1990 | Temelli | 110/245 X |
| 4,962,711 | 10/1990 | Yamauchi et al. | 122/4 D X |

FOREIGN PATENT DOCUMENTS

| | | | |
|---|---|---|---|
| 0162748 | 11/1985 | European Pat. Off. . | |
| 2449798 | 4/1976 | Fed. Rep. of Germany | 110/245 |
| 2836531 | 3/1979 | Fed. Rep. of Germany . | |
| 3441923 | 5/1986 | Fed. Rep. of Germany | 431/170 |
| 59-164816 | 9/1984 | Japan . | |
| 50-175849 | 11/1984 | Japan . | |
| 60-160337 | 10/1985 | Japan . | |
| 61-195208 | 8/1986 | Japan . | |
| 61-211614 | 9/1986 | Japan . | |
| 62-18510 | 2/1987 | Japan . | |
| 1015183 | 4/1983 | U.S.S.R. | 431/7 |
| 858813 | 1/1961 | United Kingdom . | |
| 2083184 | 3/1982 | United Kingdom | 110/245 |

*Primary Examiner*—Carl D. Price

*Attorney, Agent, or Firm*—Oblon, Spivak, McClelland, Maier & Neustadt

[57] ABSTRACT

A fluidized bed combustion furnace comprising a throttle section (12) formed directly above a fluidized bed (18) so that the flow velocity of combustion gas in the throttle section becomes higher than the terminal velocity of grains or particles of a fluidizing medium which have a mean diameter, secondary air supply ports (22) provided in the throttle section in a plurality of stages, a free board section (13) formed above the throttle section, the free board section having such a cross-sectional area that the gas flow velocity becomes lower than the terminal velocity of mean diameter grains or particles of the fluidizing medium, two or more combustion gas inlets (16*a*) and (17*a*) of combustion gas passages (16) and (17) provided in an area of the ceiling portion of the free board section which is not coincident with the plane of projection of the throttle section, and a junction chamber (25) provided at the outlets of the combustion gas passages so that high-temperature gases passing through the combustion gas passages collide and merge with each other in the junction chamber.

9 Claims, 2 Drawing Sheets

(b)

(a)

(a)

(b)

FLUIDIZED BED COMBUSTION FURNACE

TECHNICAL FIELD

The present invention relates to a fluidized bed combustion furnace and, more particularly, to a fluidized bed combustion furnace which is suitable for improving the mixing of unburnt gas from the fluidized bed section and secondary air, preventing scattering of the fluidizing medium outside the free board section and further causing high-temperature gases to collide with each other in a junction chamber, thereby completely burning trace amounts of unburnt gases, for example, CO.

BACKGROUND ART

Fluidized bed combustion furnaces need a free board in order to resettle a fluidizing medium, for example, sand, scattered at the fluidized bed section. If the flow velocity of the combustion gas ascending through the free board section is excessively high, the fluidizing medium scatters outside the free board section; therefore, the flow velocity of the combustion gas at the free board section is restricted to about 2 m/s. Accordingly, the free board section is generally arranged such that the cross-sectional area (horizontal section area) of the free board section is larger than that of the fluidized bed section.

In this arrangement, however, since the flow velocity of the combustion gas at the free board section is low, even if secondary air is supplied to the free board section, it is difficult to effect proper mixing of the unburnt gas and air, resulting in a lowering of the secondary combustion efficiency. In order to promote the mixing of such unburnt gas and air, various proposals have been made regarding the method by which air is supplied to the free board section. However, due to the wide cross-sectional area of the free board section the advantageous effects of these proposals are not able to be satisfactorily realized in the present state of the art.

There has also been proposed an arrangement wherein a throttle section is provided above the fluidized bed, as disclosed, for example, in Japanese Utility Model Public Disclosure (KOKAI) No. 62-18510. In this proposed arrangement, however, if the degree of throttling effected by the throttle section is excessively high, the flow velocity of the fluidizing medium becomes higher than the "terminal velocity" of grains or particles having a mean diameter and consequently a large amount of fluidizing medium is scattered outside the free board section, which necessitates incorporation of a means for returning scattered sand.

There is another problem that a large number of dead spaces which do not contribute to combustion are produced in the space extending between each pair of adjacent throttle portions which are provided in a multistage structure and in the space created due to the configuration of the free board section and therefore air which is blown into the furnace as secondary air, for example, cannot be effectively utilized.

Accordingly, to overcome the problems in the above-described equipment it is necessary either to reduce the degree of throttling effected by the throttle section or to provide a means for returning entrained sand.

To raise the temperature of a fluidizing medium, for example, sand, in conventional fluidized bed combustion furnaces, it is common to use an auxiliary burner or to lower the excess air ratio by increasing the burning rate. However, employment of an auxiliary burner necessitates the use of an auxiliary fuel, which is uneconomical, and an operation utilizing a low excess air ratio is problematic in that it generates such unburnt gases as CO and $NH_3$.

In view of the above-described circumstances, it is an object of the present invention to provide a fluidized bed combustion furnace wherein the flow velocity of combustion gas in the throttle section is made higher than the terminal velocity (about 2 to 8 m/s) of mean diameter grains or particles of a fluidizing medium constituting the fluidized bed, and is effectively settling the scattered fluidizing medium in the free board section, thereby minimizing scattering of the fluidizing medium outside the free board section and improving the mixing of unburnt gas and secondary air, and wherein high-temperature combustion gases which are separated off from the free board section are caused to collide with each other in a junction chamber, thereby completely burning any trace amount of unburnt matter in the junction chamber, without the need for an auxiliary fuel to raise the temperature of the fluidizing medium constituting the fluidized bed and without any generation of unburnt gases such as CO and $NH_3$.

DISCLOSURE OF THE INVENTION

To attain the above-described object, the present invention provides a fluidized bed combustion furnace having the following arrangement:

The fluidized bed combustion furnace comprises a throttle section formed directly above a fluidized bed so that the flow velocity of combustion gas in the throttle section becomes higher than the terminal velocity of grains or particles of a fluidizing medium which have a mean diameter, secondary air supply ports provided in the throttle section in a plurality of stages, a free board section formed above the throttle section, the free board section having such a cross-sectional area (horizontal section area) that the gas flow velocity becomes lower than the terminal velocity of mean diameter grains or particles of the fluidizing medium, two or more combustion gas inlets (which may be viewed as outlets from the free board section, however are referred to as inlets since they are openings extending into the exhaust passages) of combustion gas exhaust passage provided in an area of the ceiling portion of the free board section which is not coincident with the plane of the vertical projection of the throttle section, and a junction chamber provided at the outlets of the combustion gas passages so that high-temperature gases passing through the combustion gas passages collide and merge with each other in the junction chamber.

In addition, tertiary air supply ports which blow in tertiary air horizontally or downwardly are provided in the vicinities of the combustion gas passages and also in the side wall of the lower part of the free board section.

In addition, secondary air supply ports are provided so as to blow in secondary air downwardly.

In addition, the secondary air supply ports provided in the throttle section are set at a predetermined angle with respect to the direction tangent to the furnace wall as viewed in the cross section (horizontal section) of the furnace.

BRIEF DESCRIPTION OF THE DRAWINGS:

FIG. 1(*b*) is a sectional view taken along the line A—A of FIG. 1(*a*);

FIG. 2(*b*) is a view showing the flow of secondary air within the throttle section.

BEST MODE FOR CARRYING OUT THE INVENTION

The mode for carrying out the present invention will be described below with reference to the drawings.

Figure 1:
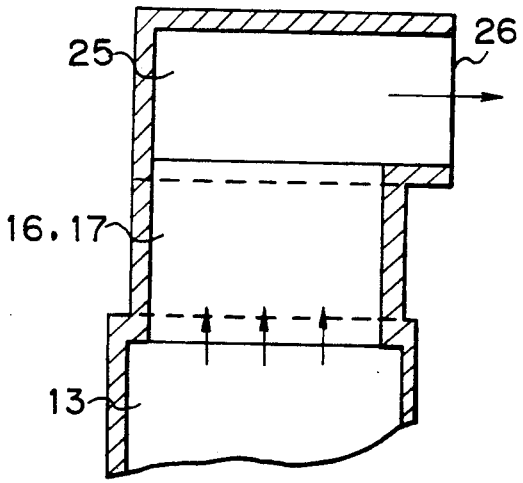
FIG. 1(*a*) is a vertical sectional view schematically showing the arrangement of a fluidized bed combustion furnace according to the present invention.
Figure 1:
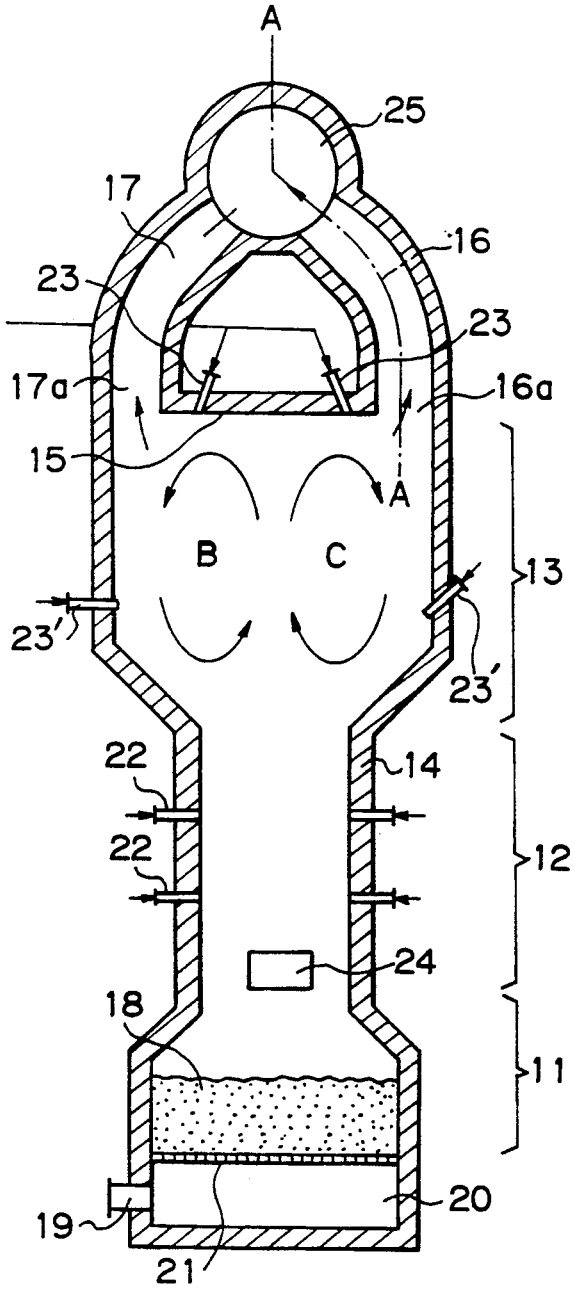

FIG. 1(*a*) is a vertical sectional view schematically showing the arrangement of one embodiment of a fluidized bed combustion furnace according to the present invention, and FIG. 1(*b*) is a sectional view taken along the line A—A of FIG. 1(*a*).

As illustrated, the fluidized bed combustion furnace has a fluidized bed section 11, a throttle section 12 formed directly above it, and a free board section 13 formed directly above the throttle section 12, the free board section 13 having a greater cross-sectional area (horizontal section area) than that of the throttle section 12. In the uppermost part of the free board section 13 is provided a ceiling portion 15 which has a larger cross-sectional area than that of the throttle section 12.

In an area of the ceiling portion 15 of the free board section 13 which is not coincident with the plane of projection of the throttle section 12 are provided combustion gas exhaust inlets 16*a* and 17*a* of combustion gas passages 16 and 17 in bilateral symmetry with each other. The respective outlets of the combustion gas passages 16 and 17 open into a junction chamber 25. The junction chamber 25 is connected to an exhaust gas outlet 26.

The lower portion of the fluidized bed section 11 is provided with a pipe 19 for supplying fluidizing air, that is, primary air, for fluidizing sand serving as a fluidizing medium which constitutes a fluidized bed 18, together with an air chamber 20, an air diffuser 21, etc. The furnace wall 14 of the throttle section 12 is provided with secondary air supply ports 22 in a plurality (two in the figure) of stages for supplying secondary air horizontally. In the vicinities of the combustion gas inlets 16*a* and 17*a* of the combustion gas passages 16 and 17 in the ceiling portion 15 of the free board section 13 and in the side wall of the lower part of the free board section 13 are provided a plurality (two for each in the figure) of tertiary air supply ports 23 and 23' for supplying tertiary air downwardly or horizontally.

It should be noted that reference numeral 24 in the figure denotes a feed port through which combustion materials are fed, for example, refuse, coal, etc.

Primary air is supplied to the air chamber 20 through the pipe 19 and then supplied to the fluidized bed 18 from the lower side of the bed through the air diffuser 21. Secondary air is supplied from the secondary air supply ports 22 provided in the furnace wall 14 of the throttle section 12. Since the cross-sectional area (horizontal section area) of the throttle section 12 is relatively small the flow velocity of combustion gas becomes higher than the terminal velocity (about 2 to 8 m/s) of grains of sand which have a mean diameter and mixing of unburnt gas and secondary air is thereby promoted. The diameter of grains of sand in the fluidized bed 18 is from about 0.2 mm to 0.8 mm, and the secondary air supply ports 22 are spaced apart from the surface of the fluidized bed 18 (i.e., the upper surface of the sand layer) at an appropriate distance (height). More specifically, if the secondary air supply ports 22 are positioned so as to be too close to the surface of the fluidized bed 18, sand blown up from the bed surface is undesirably moved to the free board section 13. Conversely, if the secondary air supply ports 22 are positioned so as to be too remote from the surface of the fluidized bed 18, flames will correspondingly be generated too remote from the surface of the fluidized bed 18 (i.e., the upper surface of the sand layer), resulting in an increase in the amount of unburnt gas. Accordingly, the height of the secondary air supply ports 22 from the surface of the fluidized bed 18 is preferably set at from about 1 to 5 m.

It should be noted that, even in such a case, a part of the sand layer is blown up as far as the secondary air supply ports 22 in the throttle section 12 and a large percentage of the layer is blown up as far as the free board section 13 because the flow velocity thereof exceeds the terminal velocity. At the same time, if the free board section 13 is provided with a single combustion gas outlet, the combustion gas blown up from the throttle section 12 ascends while defining a dead space in that portion of the cross section (horizontal section) of the free board section 13 which is not coincident with the plane of projection of the throttle section 12 having the same effect as if the combustion gas passage had a cross section smaller than the design cross section of the free board section, so that the actual flow velocity of the combustion gas is higher than the design gas flow velocity, thus giving rise to the problems that the dwelling time required for combustion of unburnt gas cannot be accurately set and that the sand reaching the free board section scatters outside the furnace because of the high flow velocity.

In contrast to this, if the combustion gas inlets 16*a* and 17*a* of the combustion gas passages 16 and 17 are provided in bilateral symmetry with each other in an area of the ceiling portion 15 of the free board section 12 which is not coincident with the plane of projection of the throttle section 12 as in the case of this embodiment, the combustion gas in the free board section 13 separates off to the right and left in the vicinity of the ceiling portion 15. More specifically, the combustion gas becomes two symmetric whirling flows [see the whirling flows B and C in FIG. 1(*a*)] each comprising ascending and descending flows as viewed in the vertical section of the furnace and the free board section 13 therefore has no dead space with an absence of combustion gas flows. Thus, it is possible to ensure the dwelling time required for combustion of unburnt gas.

If a combustion gas outlet is provided in the center of the upper part of the free board section 13, the sand blown up to the throttle section 12 flows out of the furnace with the flow of combustion gas. However, with the arrangement of the present invention, most of the sand blown up collides with the ceiling portion 15 of the free board section 13 and then drops therefore resulting in a reduction in the amount of sand flowing out of the furnace.

In addition, the greater part of the sand blown up from the throttle section 12 decelerates in the free board section 13 and thus forms a high-temperature sand layer in the lower part of the free board section 13 and further settles down onto the surface of the fluidized bed 18 (i.e., the upper surface of the sand layer) along the inner wall surface of the throttle section 12. Unburnt gas passes through this sand layer, thereby promoting the reaction.

Tertiary air is supplied in a downward direction through the tertiary air supply ports 23 near the combustion gas inlets 16*a* and 17*a* of the combustion gas passages 16 and 17 provided in the ceiling portion 15 of the free board section 13 and the combustion gas is therefore also caused to flow in a downward direction. As a result, circulation of the combustion gas in the free board section 13 is induced. Tertiary air may be additionally supplied in a horizontal or downward direction from the side wall of the lower part of the free board section 13 through the tertiary air supply ports 23'. The action of the downward flow of the circulating gas also prevents scattering of sand into the combustion gas passages 16 and 17 through the combustion gas inlets 16*a* and 17*a*.

The high-temperature combustion gas flowing into the combustion gas passages 16 and 17 from the combustion gas inlets 16*a* and 17*a* provided in bilateral symmetry with each other in two end portions of the ceiling portion 15 flows into the junction chamber 25 through the symmetrically disposed combustion gas passages 16 and 17 which have a cross section such as provides a flow velocity in the range of from 10 m/s to 20 m/s. In the junction chamber 25, the two flows of high-temperature combustion gas collide with each other at substantially the same flow rate and thereby mix with each other. Thus, the combustion of the unburnt component remaining in the combustion gas is further promoted in the junction chamber 25.

Figure 2:
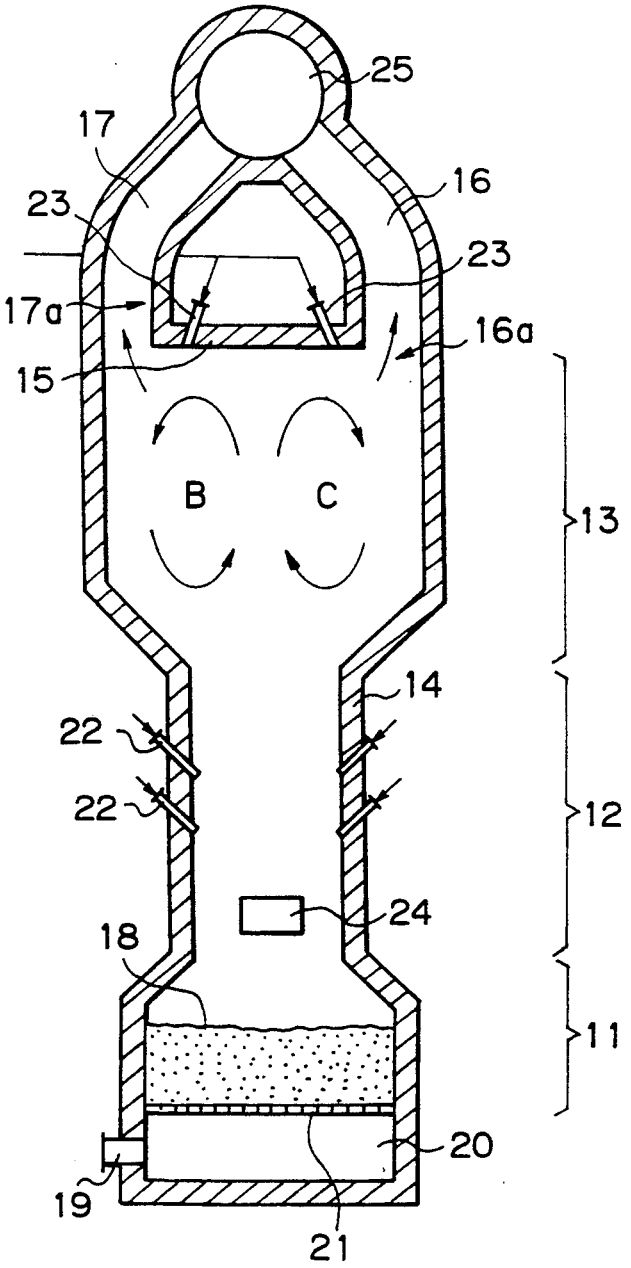
FIG. 2(*a*) is a vertical sectional view schematically showing the arrangement of another fluidized bed combustion furnace according to the present invention.
Figure 2:
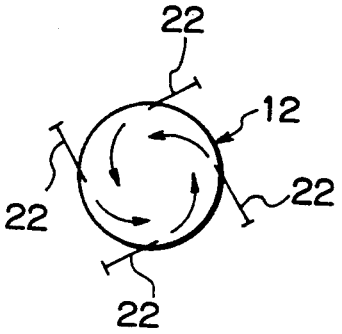

FIG. 2(*a*) is a vertical sectional view schematically showing the arrangement of another fluidized bed combustion furnace according to the present invention, and FIG. 2(*b*) is a view showing the flow of secondary air within the throttle section. In these figures, the same reference numerals as those in FIG. 1 denote the same or corresponding elements or portions. As illustrated, in this embodiment the secondary air supply ports 22 are provided in the furnace wall 14 of the throttle section 12 in two stages and disposed such that the flow of secondary air is supplied therethrough in a downward direction and the supplied secondary air swirls in the throttle section 12, as shown in FIG. 2(*b*). More specifically, the secondary air supply ports 22 are provided in a downward direction and at a predetermined angle with respect to the direction tangent to the furnace wall 14 as viewed in the cross section of the furnace.

In the fluidized bed combustion furnace having the above-described arrangement, when a rise in the temperature of the sand constituting the fluidized bed 18 is desired, secondary air is blown in downwardly from the first-stage secondary air supply ports 22, thereby forming flames close to the surface of the fluidized bed 18 (i.e., the upper surface of the sand layer), and thus raising the temperature of the sand. Normally, secondary air is blown in from the second-stage secondary air supply ports 22.

It should be noted that the secondary air supply ports 22 may be provided in three or more stages.

The exhaust gas from the exhaust gas outlet 26 may also be recirculated as secondary or tertiary air.

With the fluidized bed combustion furnace arranged as described above, the temperature of sand serving as a fluidizing medium can be raised without the need to use an auxiliary burner or lower the excess air ratio by increasing the burning rate. There is, therefore, neither any need for an auxiliary fuel nor any fear of unburnt gases such as CO and $NH_3$ gases being generated.

As has been described above, the present invention provides the following advantageous effects.

The flow velocity of combustion gas in the throttle section 12 is increased (to be higher than the terminal velocity of mean diameter grains or particles of the fluidizing medium), so that mixing of unburnt gas and the secondary air is promoted.

The free board section 13 is designed to have a larger cross-sectional area (horizontal section area) than that of the throttle section 12 so that the gas flow velocity will be lower than the terminal velocity of the fluidizing medium, the free board section 13 having the ceiling portion 15 in the uppermost part thereof, and two or more combustion gas inlets of combustion gas passages (the two, right and left, combustion gas inlets 16*a* and 17*a* of the combustion gas passages 16 and 17 in the embodiment) are symmetrically provided in an area of the ceiling portion 15 which is not coincident with the plane of projection of the throttle section 12. Accordingly, the ascending combustion gas and the fluidizing medium blown up from the fluidized bed 18 are collided with the ceiling portion 15, and the combustion gas then circulates toward the combustion gas passages disposed in symmetry with each other. At this time, the fluidizing medium accompanying the combustion gas collides with the ceiling portion 15 and separates from the ascending combustion gas. Thus, the fluidizing medium is prevented from being scattered outside the free board section 13.

Since two or more combustion gas passages 16 and 17 are symmetrically provided in an area of the ceiling portion 15 which is not coincident with the plane of projection of the throttle section 12 and further the tertiary air supply ports 23 are provided in a downward or horizontal direction in the vicinities of the combustion gas passages 16 and 17 and also in the side wall of the lower part of the free board section 13, tertiary air is blown in not horizontally but at an angle with respect to the flow of the combustion gas, thus causing the combustion gas to form two large symmetrical whirling flows which are in a turbulent state and each of which comprises ascending and descending flows as viewed in the vertical section of the furnace. There is therefore no danger of a dead space being generated in the free board section 13, and an adequate dwelling time for the combustion gas is ensured by the whole free board section 13. Thereafter, the combustion gases are discharged through the combustion gas passages 16 and 17 and then merge and collide with each other in the junction chamber 25 above the passages 16 and 17. Accordingly, any trace amount of unburnt gas remaining in the combustion gas is completely burned in the junction chamber 25, and the combustion gas after complete combustion is discharged to the outside from the exhaust gas outlet 26.

With the above-described advantageous effects, it is possible to provide a fluidized bed combustion furnace in which the average flow velocity of the combustion gas passing through the cross section of the free board section 13 can be maintained at a level lower than the terminal velocity of the fluidizing medium and which is superior in terms of combustion efficiency.

As to the fluidizing medium that is blown up together with the combustion gas ascending to the free board section 13, the greater part of it separates and settles down due to of a reduction in the flow velocity of the gas in the free board section 13, while the rest of the fluidizing medium that accompanies the combustion gas collides with the ceiling portion 15 and separates from the gas and is then effectively resettled at the lower part of the free board section 13 by the action of the descending flows of the above-mentioned whirling flows. If the throttle section 12 is provided with secondary air supply ports 22 which blow in secondary air downwardly, as shown in FIG. 2(*b*), when it is desired to raise the temperature of the fluidizing medium constituting the fluidized bed 18, flames are not blown up by the flow of the combustion gas but blown against the surface of the fluidized bed 18 (i.e., the upper surface of the sand layer) instead. It is therefore, unnecessary to use an auxiliary burner or lower the excess air ratio by increasing the burning rate as in the case of the prior art.

The above-described effectiveness is further enhanced by providing the secondary air supply ports 22 at a predetermined angle with respect to the direction tangent to the cross section (horizontal section) of the throttle section 12, as shown in FIG. 2(*b*).

INDUSTRIAL APPLICABILITY

Thus, the fluidized bed combustion furnace comprises a throttle section formed directly above a fluidized bed so that the flow velocity of combustion gas in the throttle section becomes higher than the terminal velocity of grains or particles of a fluidizing medium which have a mean diameter, secondary air supply ports provided in the throttle section in a plurality of stages, a free board section formed above the throttle section, the free board section having such a cross-sectional area that the gas flow velocity becomes lower than the terminal velocity of mean diameter grains or particles of the fluidizing medium, two or more combustion gas inlets of combustion gas passages provided in an area of the ceiling portion of the free board section which is not coincident with the plane of projection of the throttle section, and a junction chamber provided at the outlets of the combustion gas passages so that high-temperature gases passing through the combustion gas passages collide and merge with each other in the junction chamber. Accordingly, the average flow velocity of the combustion gas passing through the cross section of the free board section can be maintained at a level lower than the terminal velocity of the fluidizing medium and the dwelling time required for the combustion gas in the free board section can therefore satisfactorily be ensured. In addition, any trace amount of unburnt gas remaining in the combustion gas is burned in the junction chamber. Thus, it is possible to provide a fluidized bed combustion furnace which is superior in terms of combustion efficiency.

We claim:

1. A fluidized bed combustion furnace comprising:

a throttle section formed directly above a fluidized bed and having a cross-sectional area which is less than a cross-sectional area of the fluidized bed so that the flow velocity of combustion gas in said throttle section becomes higher than the terminal velocity of grains or particles of a fluidizing medium which have a mean diameter;

secondary air supply ports provided in said throttle section;

a free board section formed above said throttle section, said free board section having a cross-sectional area which is larger than the cross-sectional area of said throttle section such that the gas flow velocity becomes lower than the terminal velocity of mean diameter grains or particles of the fluidizing medium, said free board section further including side walls defining sides of said free board section;

a ceiling portion partially enclosing a top portion of said free board section; and at least two combustion gas inlets for combustion gas exhaust passages provided adjacent the ceiling portion of said free board section, and provided in an area which is not coincident with a plane of vertical projection of said throttle section, said inlets for combustion gas exhaust passages provided between said ceiling portion and said side walls, with said combustion gas exhaust passages extending upwardly to allow combustion gases to exit from said free board section.

2. The fluidized bed combustion furnace of claim 1, wherein said secondary air supply ports are located at a distance of at least 1 meter from the fluidized bed and not greater than 5 meters from the fluidized bed.

3. A fluidized bed combustion furnace comprising:

a throttle section formed directly above a fluidized bed and having a cross-sectional area which is less than a cross-sectional area of the fluidized bed so that the flow velocity of combustion gas in said throttle section becomes higher than the terminal velocity of grains or particles of a fluidizing medium which have a mean diameter;

secondary air supply ports provided in said throttle section in a plurality of stages disposed at different heights in said throttle section;

a free board section formed above said throttle section, said free board section having a cross-sectional area which is larger than the cross-sectional area of said throttle section such that the gas flow velocity becomes lower than the terminal velocity of mean diameter grains or particles of the fluidizing medium;

a ceiling portion at least partially enclosing a top of said free board section; and at least two combustion gas inlets for combustion gas exhaust passages provided in the ceiling portion of said free board section in an area which is not coincident with a plane of vertical projection of said throttle section.

4. A fluidized bed combustion furnace according to claim 3, wherein tertiary air supply ports are positioned in at least one of a horizontal and a downward direction in the vicinities of said combustion gas exhaust passages and also in a side wall of a lower part of said free board section.

5. A fluidized bed combustion furnace according to claim 3 or 4, wherein said secondary air supply ports are provided so as to blow in secondary air downwardly.

6. A fluidized bed combustion furnace according to claim 3, wherein the secondary air supply ports provided in said throttle section are set at a predetermined angle with respect to the direction tangent to the furnace wall as viewed in the cross section of the furnace.

7. A fluidized bed combustion furnace according to claim 3, wherein a junction chamber is provided at outlets of said combustion gas exhaust passages so that high-temperature gases passing through said combustion gas exhaust passages collide with each other in said junction chamber.

8. A fluidized bed combustion furnace according to claim 7, wherein an additional exhaust gas passage through which combustion gas is discharged from said junction chamber is disposed at a right angle with said combustion gas passages.

9. The fluidized bed combustion furnace of claim 3, wherein said secondary air supply ports are located at a distance of at least 1 meter from the fluidized bed and not greater than 5 meters from the fluidized bed.

* * * * *